US007134525B1

(12) United States Patent
Ferris

(10) Patent No.: US 7,134,525 B1
(45) Date of Patent: Nov. 14, 2006

(54) LADDER STABILIZATION APPARATUS AND SYSTEM

(76) Inventor: John N. Ferris, 130 Holmar Trail, McDonough, GA (US) 30253

( * ) Notice: Subject to any disclaimer, the term of this patent is extended or adjusted under 35 U.S.C. 154(b) by 0 days.

(21) Appl. No.: 10/871,693

(22) Filed: Jun. 17, 2004

Related U.S. Application Data

(60) Provisional application No. 60/555,286, filed on Mar. 23, 2004.

(51) Int. Cl.
*E06C 7/00* (2006.01)

(52) U.S. Cl. ..... 182/107; 182/206

(58) Field of Classification Search ..... 182/107, 182/206, 214; 248/231.51, 316.5, 229.15
See application file for complete search history.

(56) References Cited

U.S. PATENT DOCUMENTS 2,914,829 A * 12/1959 Willemain ..... 248/229.15
2,999,290 A * 9/1961 Giles ..... 248/237
3,910,380 A * 10/1975 Nameche ..... 182/206
4,141,524 A * 2/1979 Corvese, Jr. ..... 248/70
4,280,590 A * 7/1981 Polizzi ..... 182/214
5,667,176 A * 9/1997 Zamarripa et al. ..... 248/231.51
6,029,774 A 2/2000 Cothern
6,044,930 A 4/2000 Hayman
6,065,566 A 5/2000 Brown et al.
6,112,853 A 9/2000 Beard
6,152,262 A 11/2000 Jung
6,253,876 B1 7/2001 Cosgrave et al.
6,276,668 B1 8/2001 Sweeley
6,357,710 B1 * 3/2002 Fielden et al. ..... 248/276.1
6,408,983 B1 6/2002 Widurski
6,527,084 B1 3/2003 Hrincu
6,595,324 B1 7/2003 Brown
6,691,825 B1 2/2004 Haig
6,698,546 B1 3/2004 Sandor, Sr.
2004/0055820 A1 * 3/2004 Charlton ..... 182/107

* cited by examiner

*Primary Examiner*—Alvin Chin-Shue
(74) *Attorney, Agent, or Firm*—Myers & Kaplan, LLC; Joel D. Myers, Esq.; Robert A Madayag, III, Esq.

(57) ABSTRACT

A ladder stabilization apparatus and system. The apparatus includes a main clamp body, a first slotted arm having a first end and a second end, the first end being pivotally connected to the main clamp body, and a second slotted arm having a first end and a second end, the second end of the first slotted arm being connected to the second slotted arm.

2 Claims, 3 Drawing Sheets

LADDER STABILIZATION APPARATUS AND SYSTEM

Priority based on U.S. Provisional Patent Application No. 60/555,286, filed Mar. 23, 2004, entitled "Ladder Stabilizer", is claimed.

BACKGROUND

I. Field of the Invention

The present invention relates generally to the field of ladders and extension ladders, and more particularly to a ladder stabilization apparatus and system.

II. Description of the Related Art

Ladders and extension ladders are used for a variety of purposes including access to roofs. Typically a user positioned the ladder against the structure at an angle and proceeds to climb the ladder. If the user desires to leave the ladder and move to the roof, the user must take care to carefully position him or herself and shift body weight from the ladder to the roof making sure not to topple the ladder.

SUMMARY

In general, the invention features a ladder stabilization apparatus and system that secures the ladder to a portion of a structure thereby providing stability to the ladder. In a typical embodiment, the apparatus includes a main clamp body, a first slotted arm having a first end and a second end, the first end being pivotally connected to the main clamp body, and a second slotted arm having a first end and a second end, the second end of the first slotted arm being connected to the second slotted arm.

In general, in one aspect, the invention features a ladder stabilization apparatus, including a main clamp body, a first slotted arm having a first end and a second end, the first end being pivotally connected to the main clamp body and a second slotted arm having a first end and a second end, the second end of the first slotted arm being connected to the second slotted arm.

In one implementation, the main clamp body comprises two clamp halves, each half including a handle and a jaw.

In another implementation, each jaw comprises at least one tong oriented in opposition to a respective tong.

In another implementation, the clamp halves are connected together at a pivot point having a pin.

In another implementation, the apparatus further includes a resilient body oriented about the pin, the resilient body providing a restorative force keeping the jaws pressed together.

In another implementation, the first slotted arm comprises a short end connected generally perpendicular to a long end, the short and long ends generally forming a L-shape.

In another implementation, the apparatus further includes an elongated slot within the long end.

In still another implementation, the second slotted arm includes a long end, a first short portion connected generally perpendicular to the long end and a second short end connected generally perpendicular to the first short portion and oriented generally parallel to the long end.

In yet another implementation, the long end, and the first and second short portions generally form a body with a J-shape profile.

In another implementation, the short portions generally form a hook.

In another implementation, the apparatus further includes a connection assembly that couples the first and second slotted arms.

In another implementation, the connection assembly includes a bolt, a washer oriented about a portion of the bolt and a wing nut in threaded engagement with the bolt.

In another implementation, the connection assembly is oriented within slots on both the slotted arms and is adapted to slide within the slots and wherein the slotted arms are adapted to pivot about the connection assembly.

In another aspect, the invention features a ladder stabilization system, including a ladder having legs and rungs and at least one ladder stabilization apparatus, having a main clamp body, a first slotted arm having a first end and a second end, the first end being pivotally connected to the main clamp body, a second slotted arm having a first end and a second end, the second end of the first slotted arm being connected to the second slotted arm, wherein the second end of the second slotted arm terminates in a hook that is mechanically coupled to a leg of the ladder and a connection assembly coupling the first and second slotted arms.

In another aspect, the invention features a ladder stabilization kit, including a ladder having legs and rungs and at least one ladder stabilization apparatus, having a main clamp body, a first slotted arm having a first end and a second end, the first end being pivotally connected to the main clamp body and a second slotted arm having a first end and a second end, the second end of the first slotted arm being connected to the second slotted arm, wherein the second end of the second slotted arm terminates in a hook that is adapted to be mechanically coupled to a leg of the ladder.

One advantage of the invention is that side to side unstable movement of the ladder against a structure is greatly reduced or eliminated.

Another advantage of the invention is that ladder "kick-out" is greatly reduced or eliminated.

Another advantage of the invention is that overall ladder stability against a structure is increased.

Another advantage of the invention is that it provides several points of articulation so that the apparatus can be set into various orientations for affixation and securement of a ladder to a structure.

Another advantage is that the apparatus allows stabilization of a ladder to a structure thereby allowing a user to get on and off the ladder with increased stabilization of the ladder.

Other objects, advantages and capabilities of the invention will become apparent from the following description taken in conjunction with the accompanying drawings showing the preferred embodiment of the invention.

DETAILED DESCRIPTION

Figures 1, 1A:
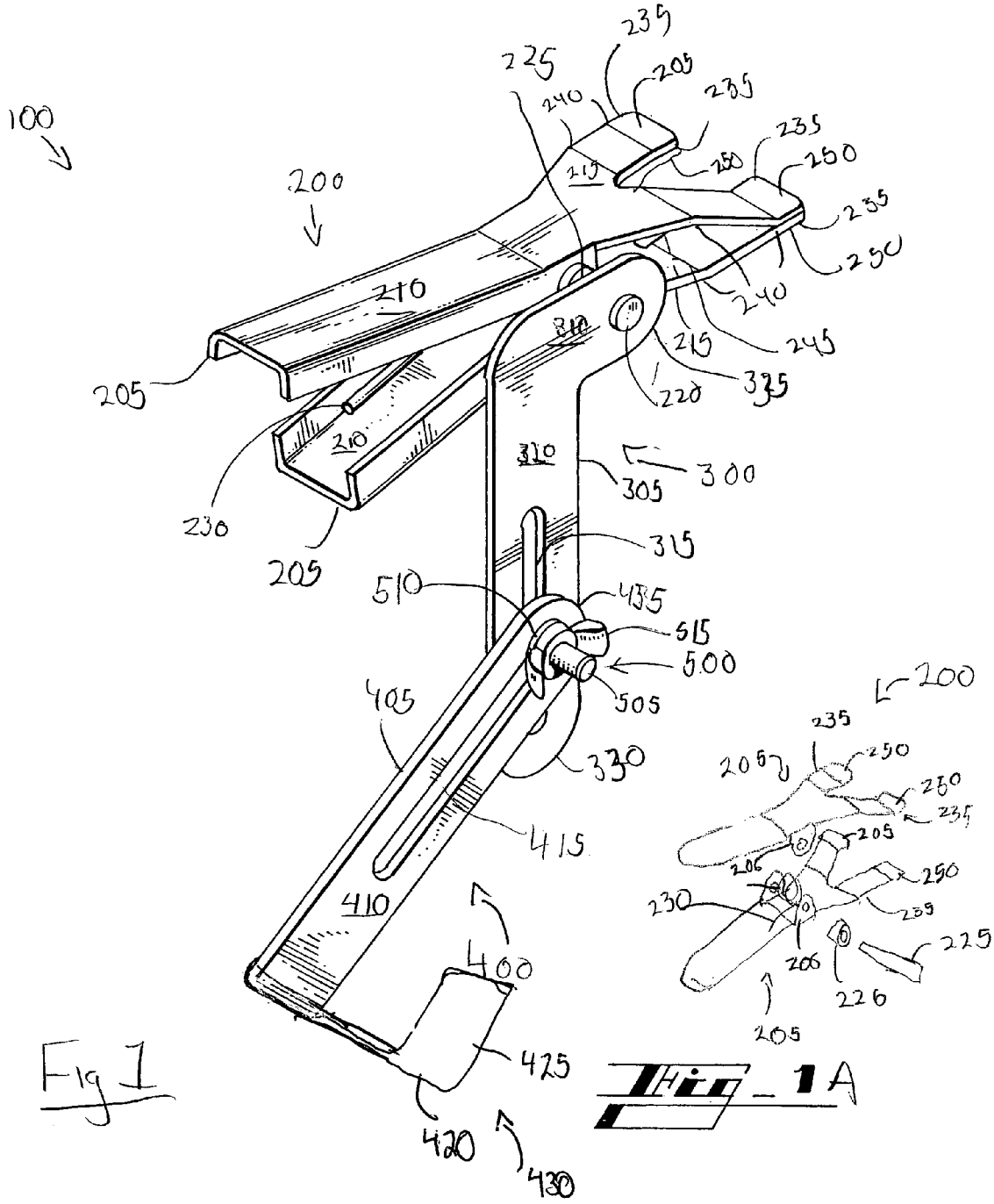
FIG. 1 illustrates a perspective view of an embodiment of a ladder stabilization apparatus.
FIG. 1A illustrates a perspective exploded view of the constituent components of an embodiment of a main clamp body of an embodiment of a ladder stabilization apparatus.

Referring to the drawings wherein like reference numerals designate corresponding parts throughout the several figures, reference is made first to FIG. 1 that illustrates a perspective view of an embodiment of a ladder stabilization apparatus 100. The apparatus 100 typically includes three main components: a clamp body 200, a first slotted arm 300 connected to the clamp body 200 and a second slotted arm 400 connected to the first slotted arm 200.

The main clamp body 200 typically includes to clamp halves 205. Each clamp half 205 typically includes a handle 210 and a jaw 215. The handles 210 and jaws 215 of each clamp half 205 are typically divided by a pivot point 220 of the main clamp body 200, around which a pin 225 is oriented thereby connecting the clamp halves 205. A resilient body 230 such as a spring is oriented about the pin 225 in order to provide a restorative force keeping the main clamp body 200 in a closed position. In the closed position the handles 210 are separated and the jaws 215 are closed upon one another. During use, the jaws 215 are typically desired to be separated for affixation on a portion of a structure as discussed further in the description below. As such, the user provides a force upon the handles 210, the force being opposite the restorative force of the resilient body 230.

Each handle 210 can be formed in a variety of suitable ways. In one embodiment, the handles 210 are formed with a general C-cross section that allows the handles 210 to overlap as the handles 210 are squeezed together as the user applies a force during use.

Each jaw 215 includes one or more tongs 235. It has been determined that the number of tongs 235 can provide different degrees of securement about the portion of the structure. Although a single tong 235 can be used on each jaw 215, in a typical embodiment, two tongs 235 provide optimal securement to the structure portion. It is understood that three or more tongs 235 is also contemplated in other embodiments. Each tong 235 typically includes a series of bends 240. The bends 240 provide several advantages. One advantage is that adequate clearance 245 is achieved between the tongs 235 where the portion of the structure fits within the tongs 235. Another advantage of the bends 240 is that a flush fit between respective opposing tong ends 250 is achieved so that a tight and secure is achieved between the tong ends 250.

FIG. 1A illustrates a perspective exploded view of the constituent components of an embodiment of a main clamp body 200 of an embodiment of a ladder stabilization apparatus 100. As described above each clamp half 205 includes the handle 210 and the jaw 215. The handles 210 and jaws 205 of each clamp half 205 are divided by the pivot point 220 of the main clamp body 200, around which the pin 225 is oriented thereby connecting the clamp halves 205. The resilient body 230 is oriented about the pin 225 in order to provide a restorative force keeping the main clamp body 200 in a closed position. Each of the clamp halves 205 includes a tab 206 on either side of the clamp half 205 adjacent both the handles 210 and jaws 215. The tabs 206 provide the locations through which the pin 225 can be inserted to connect the clamp halves 205. A washer 226 can be inserted to provide spacing between the main clamp body 200 and the first slotted arm 300 as discussed further in the description below. The pin can be properly riveted on either side to prevent the constituent components from coming apart. In another embodiment, the pin 225 can be a bolt and a nut and washer can be connected on the end of the bolt to keep the constituent components together.

Referring again to FIG. 1, as discussed above, the apparatus further includes a first slotted arm 300 and a second slotted arm 400.

The first slotted arm 300 is pivotally connected to the main clamp body 200 about the pin 225 as described above. The first slotted arm generally includes a L-shaped body 305. The short end 310 of the L-shaped body 305 is connected to the main clamp body 200 as described above. The long end 320 of the L-shaped body 305 includes a slot 315 that couples to the second slotted arm 400 as discussed further in the description below. The ends 330, 335 of the L-shaped body 305 are typically rounded to provide smooth edges that do not provide rough edges that can become prohibitive during use. Although the first slotted body 300 can be elongated without an L-shape, the short end 310 being proximate the main clamp body 200 provides certain advantages that are appreciated in the description below.

The second slotted body 400 is connected to the first slotted body 300 as described above. The second slotted body 400 has a body 405 having generally J-shaped profile. The loop of the "J" includes a first short portion 420 connected and oriented generally perpendicular to the long end 410 of the body 405. A second portion 425 is connected perpendicular to the first short portion 420 and oriented parallel to the long end 410. The orientation of the long end 410 and the first and second short portions 420, 425 form a hook 430 on the end of the slotted arm 400 opposite the end 435 connected to the first slotted arm 300. In general, the hook 430 connects to the leg of a ladder and the main clamp body 200 is connected to a portion of a structure as described further below. The hook 430 provides several advantages as discussed further in the description below.

The long end 410 of the body 405 includes the slot 415. The slots 315, 415 of the slotted arms 300, 400 are coupled together by a connection assembly 500 typically including a bolt 505, washer 510 and wing-nut 515. It is understood that the connection assembly 500 can be comprised of several types of suitable components. The connection assembly 500 as described provides a quick, efficient and convenient method of orienting the apparatus into suitable positions. By tightening and loosening the wing nut 515 as needed, the user can orient the first and second slotted arms 300, 400 into a variety of positions. The connection assembly 500 can therefore be used to slide the arms 300, 400 with respect to each other and also pivot the arms 300, 400 with respect to each other. It is therefore appreciated that there is a large spectrum of positions that the arms 300, 400 can take with respect to one another. The slots 315, 415 provide a large degree of freedom through which the arms 300, 400 can be slid. In addition, virtually any pivotal orientation through 360 degrees can be attained. Once a desired orientation is attained, the wing-nut 515 is tightened to secure the desired orientation.

Figure 2:
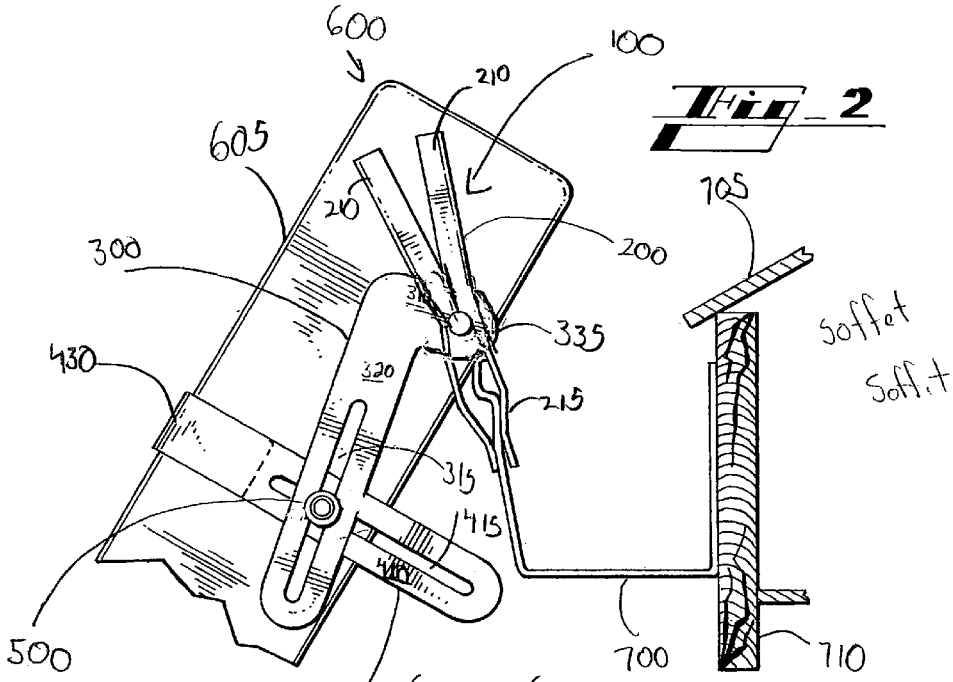
FIG. 2 illustrates a side view of an embodiment of a ladder stabilization apparatus connected to a ladder and adjacent a gutter in a first orientation.
Figure 3:
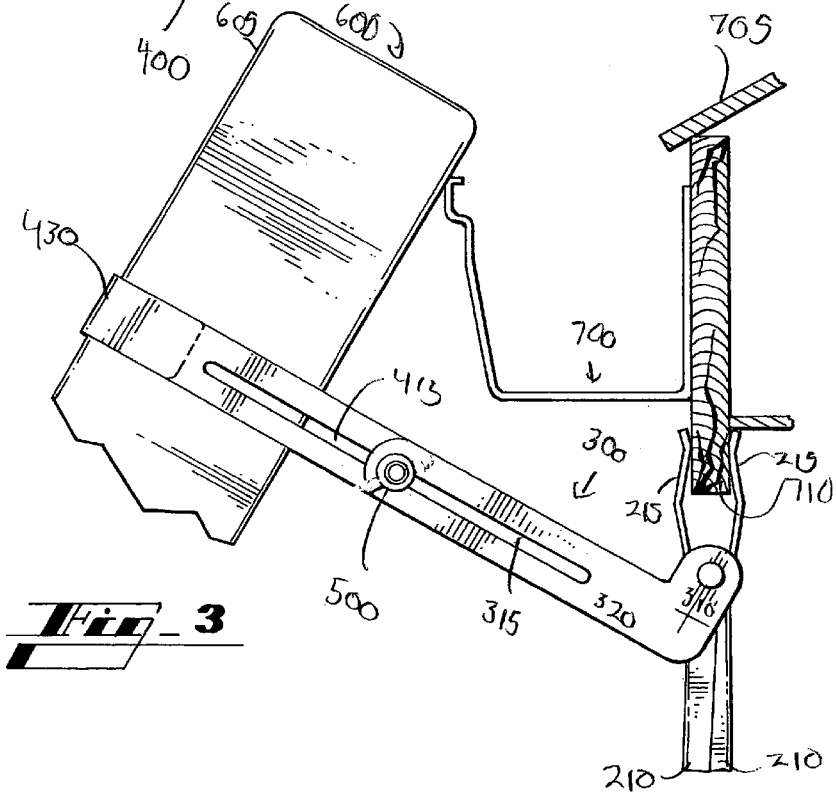
FIG. 3 illustrates a side view of an embodiment of a ladder stabilization apparatus connected to a ladder and adjacent a gutter in a second orientation.

In the descriptions above, the basic ladder stabilization apparatus has been described. FIGS. 2 and 3 illustrate specific orientations that the apparatus 100 can be positioned to stabilize a ladder next to a structure. It is understood that FIGS. 2 and 3 are only illustrative of the ways that the apparatus 100 can be used. It is further understood that there are many additional orientations possible. In addition, the outside portion of the ladder leg is illustrated. It is understood that the apparatus 100 can be placed on the inside of the ladder leg.

FIG. 2 illustrates a side view of an embodiment of a ladder stabilization apparatus 100 connected to a ladder 600 and adjacent a gutter 700 in a first orientation. In this first orientation, the ladder 600 is rested against the gutter 700 that is attached adjacent a roof 705 connected to a soffit 710. In a typical usage, the connection assembly 500 is loosened so that the arms 300, 400 can move freely with respect to each other. The hook 430 is connected to a leg 605 of the ladder 600. A force is applied to the handles 210 of the main clamp body 200 so that the jaws 215 separate. As such, the user can connect the jaws 215 to a portion of the structure such as the gutter 700. The user then releases the handles 210 so that the main clamp body 200 is securely connected to the gutter 700. The hook 430 can be repositioned if necessary. The arms 300, 400 are adjusted by sliding and pivoting the arms 300, 400 with respect to each other. During the adjustments, the connection assembly 500 is freely moving through the slots 315, 415. When the desired orientation of the arms 300, 400 is attained, the wing nut 515 can then be tightened to secure the arms 300, 400 with respect to each other. With the main clamp body 200 connected to the gutter 700, the hook 430 connected to the leg 605 and the connection assembly 500 oriented as described, the ladder 600 is stabilized with respect to the gutter 700. In the particular orientation illustrated, the first slotted arm 300 is adjacent the hook 430 and the connection assembly is about midway the slot 315. As described above, there are many different orientations that can be positioned to attain stabilization of the ladder 600. In this first orientation, it is appreciated that the short end 310 of the first slotted arm 300 helps to "clear" the first slotted arm 300 from the gutter 700. If the first slotted arm 300 were simply elongated, the first slotted arm 300 may butt up against the gutter 700 thereby inhibiting proper placement of the apparatus 100. The short end 310 being connected perpendicular to the long end 320 having the slot 315, helps to clear the long end 320 and the slot 315 from the gutter, aiding in placement of the apparatus and adjustments through the slot 315.

FIG. 3 illustrates a side view of an embodiment of a ladder stabilization apparatus 100 connected to a ladder 600 and adjacent a gutter 700 in a second orientation. In this second orientation, the ladder 600 is rested against the gutter 700 that is attached adjacent a roof 705 connected to a soffit 710. As described above, the connection assembly 500 is loosened so that the arms 300, 400 can move freely with respect to each other. The hook 430 is connected to a leg 605 of the ladder 600. A force is applied to the handles 210 of the main clamp body 200 so that the jaws 215 separate. In this second orientation, the user can connect the jaws 215 to the soffit 710 adjacent the gutter 700. The user then releases the handles 210 so that the main clamp body 200 is securely connected to the soffit 710. The second orientation illustrates another way that the apparatus 100 can be used to stabilize the ladder 600 next to a structure. The hook 430 can be repositioned if necessary. The arms 300, 400 are adjusted by sliding and pivoting the arms 300, 400 with respect to each other. During the adjustments, the connection assembly 500 is freely moving through the slots 315, 415. When the desired orientation of the arms 300, 400 is attained, the wing nut 515 can then be tightened to secure the arms 300, 400 with respect to each other. With the main clamp body 200 connected to the soffit 710, the hook 430 connected to the leg 605 and the connection assembly 500 oriented as described, the ladder 600 is stabilized with respect to the gutter 700. In the particular orientation illustrated, the apparatus is extended to a maximum extension. The arms 300, 400 are oriented a similar line and the connection assembly is located at an extreme end of both slots 315, 415. FIG. 3 further illustrates the apparatus 100 as a mirror image as discussed with respect to FIG. 2, thereby illustrating that the apparatus 100 can be oppositely oriented in use.

The following figures illustrate other views of the apparatus 100.

Figure 4:
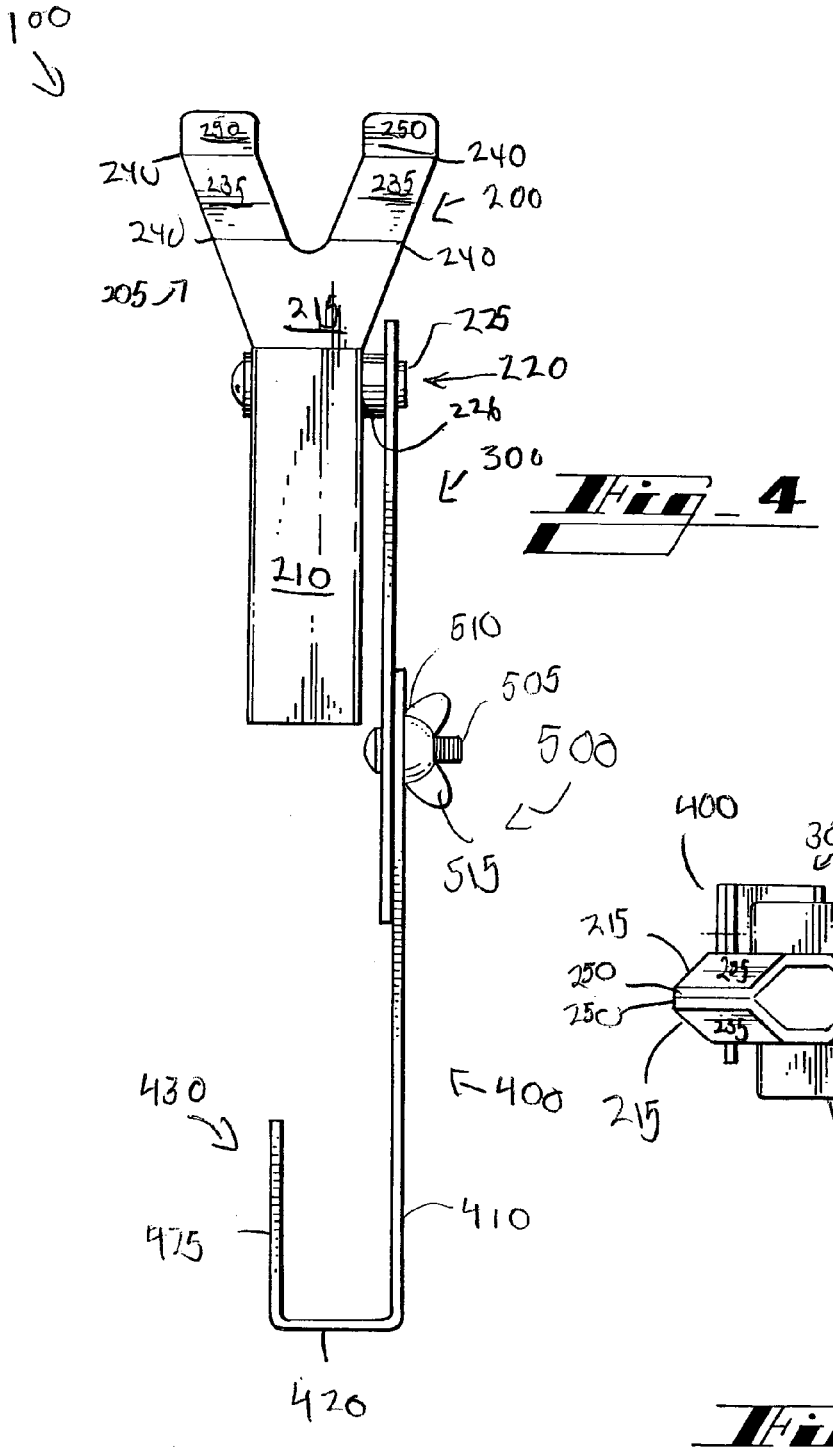
FIG. 4 illustrates a top view of an embodiment of a ladder stabilization apparatus.

FIG. 4 illustrates a top view of an embodiment of a ladder stabilization apparatus 100. The apparatus 100 includes the clamp body 200, the first slotted arm 300 connected to the clamp body 200 and the second slotted arm 400 connected to the first slotted arm 200. The main clamp body 200 typically includes two clamp halves 205, each having the handle 210 and the jaw 215. The handles 210 and jaws 215 of each clamp half 205 are typically divided by the pivot point 220 of the main clamp body 200, around which the pin 225 is oriented thereby connecting the clamp halves 205. The resilient body 230 is not shown in FIG. 4. Each jaw 215 includes one or more tongs 235. In one embodiment, two tongs 235 generally give a Y-shape to the jaws 215. Each tong 235 typically includes a series of bends 240. The tongs 235 terminate in the tong ends 250. The washer 226 can be inserted to provide spacing between the main clamp body 200 and the first slotted arm 300.

The first slotted arm 300 is pivotally connected to the main clamp body 200 about the pin 225 as described above. The second slotted body 400 is connected to the first slotted body 300 as described above. The second slotted body 400 has a body 405 having generally J-shaped profile. The loop of the "J" includes a first short portion 420 connected and oriented generally perpendicular to the long end 410 of the body 405. A second portion 425 is connected perpendicular to the first short portion 420 and oriented parallel to the long end 410. The orientation of the long end 410 and the first and second short portions 420, 425 form a hook 430 on the end of the slotted arm 400 opposite the end 435 connected to the first slotted arm 300. The slots 315, 415 of the slotted arms 300, 400 (not shown in FIG. 4) are coupled together by a connection assembly 500 as described above.

FIG. 4 further illustrates that the hook 430 is turned inward in contrast to FIG. 7, thereby showing the versatility of the apparatus 100.

Figure 5:
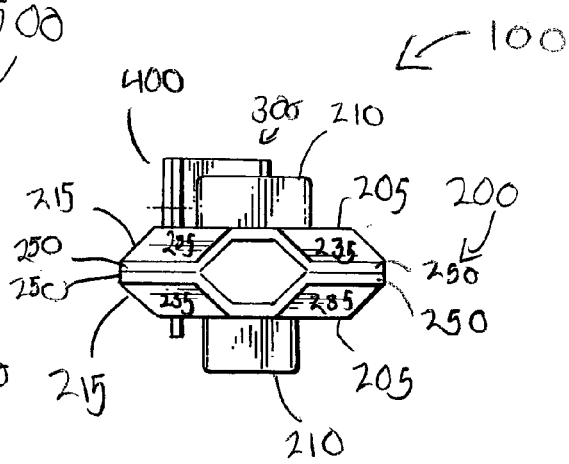
FIG. 5 illustrates a front view of an embodiment of a ladder stabilization apparatus.

FIG. 5 illustrates a front view of an embodiment of a ladder stabilization apparatus 100. The apparatus 100 includes the clamp body 200, the first slotted arm 300 connected to the clamp body 200 and the second slotted arm 400 connected to the first slotted arm 200. The main clamp body 200 typically includes two clamp halves 205, each having the handle 210 and the jaw. Each jaw 215 includes one or more tongs 235. The tongs 235 terminate in the tong ends 250. The first and second slotted arms 300, 400 are described in detail with respect to the above figures.

It is generally appreciated that it most implementations, the user must first place the ladder 600 in the desired location. The user then must climb the ladder to place the apparatus 100. In general, the apparatus 100 presents its greatest advantages for a user when the user is actually working on the ladder and leaving the ladder to enter the roof of a structure or top of other structures. It is during work and getting on and off the ladder that presents the most unstable times for ladder usage.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A ladder stabilization system, comprising:

a ladder having legs and rungs; and at least one ladder stabilization apparatus, comprising:

a main clamp body having opposable spring biased clamp halves, each half generally including a tong portion and a handle portion;

a first L-shaped slotted arm having a first end and a second end, the first end being pivotally connected to the main clamp body;

a second J-shaped slotted arm having a first end and a second end, the second end of the first slotted arm being connected to the second slotted arm, wherein the second end of the second slotted arm terminates in a hook that is mechanically coupled to a leg of the ladder; and a connection assembly pivotally coupling the first and second slotted arms in respective slots.

2. A ladder stabilization kit, comprising:

a ladder having legs and rungs; and at least one ladder stabilization apparatus, comprising:

a main clamp body having opposable spring biased clamps halves, each half generally including a tong portion and a handle portion;

a L-shaped first slotted arm having a first end and a second end, the first end being pivotally connected to the main clamp body; and a second J-shaped slotted arm having a first end and a second end, the second end of the first slotted arm being connected to the second slotted arm, wherein the second end of the second slotted arm terminates in a hook that is adapted to be mechanically coupled to a leg of the ladder; and a connection assembly pivotally coupling the first and second slotted arms in respective slots.

* * * * *